US009850804B2

(12) United States Patent
Heinrich et al.

(10) Patent No.: US 9,850,804 B2
(45) Date of Patent: Dec. 26, 2017

(54) COOLANT CIRCUIT

(71) Applicant: CONTINENTAL AUTOMOTIVE GMBH, Hannover (DE)

(72) Inventors: Stephan Heinrich, Pfeffenhausen (DE); Denny Schädlich, Neustadt (DE); Andreas Wildgen, Nittendorf (DE)

(73) Assignee: Continental Automotive GmbH, Hannover (DE)

( * ) Notice: Subject to any disclaimer, the term of this patent is extended or adjusted under 35 U.S.C. 154(b) by 55 days.

(21) Appl. No.: 14/652,671

(22) PCT Filed: Dec. 9, 2013

(86) PCT No.: PCT/EP2013/075929

§ 371 (c)(1),
(2) Date: Jun. 16, 2015

(87) PCT Pub. No.: WO2014/095451

PCT Pub. Date: Jun. 26, 2014

(65) Prior Publication Data

US 2015/0369116 A1 Dec. 24, 2015

(30) Foreign Application Priority Data

Dec. 17, 2012 (DE) ..... 10 2012 223 454

(51) Int. Cl.
*F01P 11/14* (2006.01)
*F01P 11/20* (2006.01)
(Continued)

(52) U.S. Cl.
CPC ..... *F01P 11/14* (2013.01); *F01P 5/10* (2013.01); *F01P 11/029* (2013.01); *F01P 11/16* (2013.01);
(Continued)

(58) Field of Classification Search
CPC .. F01P 11/14; F01P 5/10; F01P 11/029; F01P 11/16; F01P 11/20; F01P 2025/13; F01P 2025/80
(Continued)

(56) References Cited

U.S. PATENT DOCUMENTS 4,503,814 A * 3/1985 Fujihara ..... F01P 3/2207 123/41.3
8,855,851 B2 1/2014 Nishizawa
(Continued)

FOREIGN PATENT DOCUMENTS

CN 1800603 7/2006
DE 40 06 875 9/1991
(Continued)

OTHER PUBLICATIONS

Office Action dated Oct. 31, 2016 which issued in the corresponding Chinese Patent Application No. 201380065760.4.

*Primary Examiner* — Joseph Dallo
*Assistant Examiner* — Yi-Kai Wang
(74) *Attorney, Agent, or Firm* — Cozen O'Connor

(57) ABSTRACT

A coolant circuit for an internal combustion engine includes: a coolant pump; at least one coolant line; a radiator; and a coolant cavity delimited in the internal combustion engine. The coolant pump, the coolant line, the radiator and the coolant cavity are filled with a coolant. One or more sensors, configured to monitor the coolant concentration, are fixedly and permanently arranged in and/or on the coolant circuit.

10 Claims, 1 Drawing Sheet

(51) Int. Cl.
*F01P 5/10* (2006.01)
*F01P 11/02* (2006.01)
*F01P 11/16* (2006.01)

(52) U.S. Cl.
CPC ..... *F01P 11/20* (2013.01); *F01P 2025/13* (2013.01); *F01P 2025/80* (2013.01)

(58) Field of Classification Search
USPC ..... 123/41.15
See application file for complete search history.

(56) References Cited

U.S. PATENT DOCUMENTS

2004/0184507 A1* 9/2004 Tsukamoto ..... F01P 11/16 374/57
2005/0224019 A1* 10/2005 Kim ..... F01P 5/14 123/41.1
2006/0021588 A1 2/2006 Marsh et al.
2007/0017482 A1* 1/2007 Nakashima ..... F02D 11/107 123/399
2009/0311772 A1* 12/2009 Quinn ..... C12M 21/12 435/286.5
2010/0067560 A1* 3/2010 Kouda ..... F01P 11/16 374/145
2011/0288701 A1* 11/2011 Chen ..... B60W 10/06 701/22
2012/0130605 A1* 5/2012 Kuestler ..... B60K 28/063 701/51
2012/0160447 A1* 6/2012 Kinomura ..... B60H 1/025 165/51
2012/0227685 A1* 9/2012 Ozawa ..... F01P 7/165 123/41.08
2014/0350800 A1* 11/2014 Yoshida ..... F02D 29/02 701/50

FOREIGN PATENT DOCUMENTS

DE 10 2010 027946 A1 10/2011
GB 2 360 838 10/2001
JP S52 27938 A 3/1977
JP S5716217 A 1/1982
JP S6060005 B2 * 1/1982 ..... F01P 11/20
JP S57 171019 A 10/1982
JP H10259730 A 9/1998
JP 2007247506 A 9/2007
JP 2012086735 A * 10/2010
WO WO 2012/140748 A1 10/2012

* cited by examiner

COOLANT CIRCUIT

CROSS-REFERENCE TO RELATED APPLICATIONS

This is a U.S. national stage of application No. PCT/EP2013/075929, filed on 9 Dec. 2013, which claims priority to the German Application No. DE 10 2012 223 454.3 filed 17 Dec. 2012, the content of both incorporated herein by reference.

BACKGROUND OF THE INVENTION

1. Field of the Invention

The invention relates to a coolant circuit for an internal combustion engine, with a coolant pump, at least one coolant line, a radiator and a coolant cavity in the internal combustion engine, wherein the coolant pump, the coolant line, the radiator and the coolant cavity are filled with a coolant.

2. Related Art

The monitoring of the composition of the coolant generally takes place in motor vehicles only within the scope of workshop visits and hence frequently irregularly. In addition, the measuring of the concentration of the antifreeze agent in the coolant does not take place during each workshop visit of the vehicle. It is therefore possible for the portion of the antifreeze agent in the coolant to be reduced imperceptibly such that the coolant in the coolant circuit freezes at an ambient temperature of below 0° C. This may result in considerable damage to the internal combustion engine of a motor vehicle. However, too high a concentration of the antifreeze agent may also be disadvantageous for the coolant circuit and lead to damage to the coolant circuit.

SUMMARY OF THE INVENTION

An object of the present invention is to provide a coolant circuit that permanently protects the internal combustion engine against damage due to the incorrect use of coolants.

An aspect of the invention is distinguished in that at least one sensor for monitoring the coolant concentration is fixedly and permanently arranged in and/or on the coolant circuit. This has the advantage that it is possible, even outside workshop visits of the vehicle, reliably to identify too low a concentration of the antifreeze agent in the coolant. Too high a concentration of the antifreeze agent can also be identified with the coolant circuit according to the invention.

In a refinement, the sensor for monitoring the coolant concentration is an ultrasonic sensor. Ultrasonic sensors are cost-effective components which have a long service life and with the aid of which the concentration of the antifreeze agent in the coolant can be reliably identified.

In a development of the invention, the coolant circuit additionally has an expansion vessel. The sensor for monitoring the coolant concentration can be arranged in or on the expansion vessel. The expansion vessel is generally a readily accessible component that easily permits the mounting of a sensor for, monitoring the coolant concentration.

In a development, the sensor for monitoring the coolant concentration is arranged in or on the coolant cavity. The coolant cavity is located in the internal combustion engine itself, and therefore the sensor for monitoring the coolant concentration can particularly effectively protect the internal combustion engine from freezing.

If the sensor for monitoring the coolant concentration is arranged in or on the coolant pump and/or is arranged in or on the coolant line, an effective monitoring of the portion of the antifreeze agent in the coolant can likewise take place and therefore the coolant concentration can be reliably determined. This applies even if the sensor for monitoring the coolant concentration is arranged in or on the radiator.

In a development, the sensor for monitoring the coolant concentration transmits the measuring results thereof to an electronic control device. If the electronic control device is additionally connected to an ambient temperature sensor, it can be reliably determined whether the ambient temperature has dropped to an extent such that there is or was a risk to the cooling circuit and/or the internal combustion engine.

It is advantageous if the electronic control device ascertains a minimum use temperature for the coolant with reference to the measuring results of the sensor for monitoring the coolant concentration and compares this minimum use temperature for the coolant with the measuring result of the ambient temperature sensor. In this manner, freezing of the coolant in the coolant circuit can be reliably identified.

In order to avoid further damage to the internal combustion engine after freezing of the coolant, it is advantageous if the electronic control device generates an electronic warning signal if the measuring result of the ambient temperature sensor falls short of the minimum use temperature of the coolant. This electronic warning signal can be displayed, for example, in the form of an error message to the vehicle driver and/or can be used to the effect that the internal combustion engine cannot be started or is shut down.

If the monitoring of the coolant concentration and the ascertaining of the minimum use temperature of the coolant and the comparison with the measuring result of the ambient temperature sensor take place even after the internal combustion engine is at a standstill, the most probable scenario, namely the freezing of the switched-off internal combustion engine, can be reliably identified.

BRIEF DESCRIPTION OF THE DRAWINGS

Exemplary embodiments of the invention are explained below with reference to the drawings.

In the drawings.

DETAILED DESCRIPTION OF THE PRESENTLY PREFERRED EMBODIMENTS

Elements of identical construction and/or function are provided with the same reference signs throughout the figures.

Figure 1:
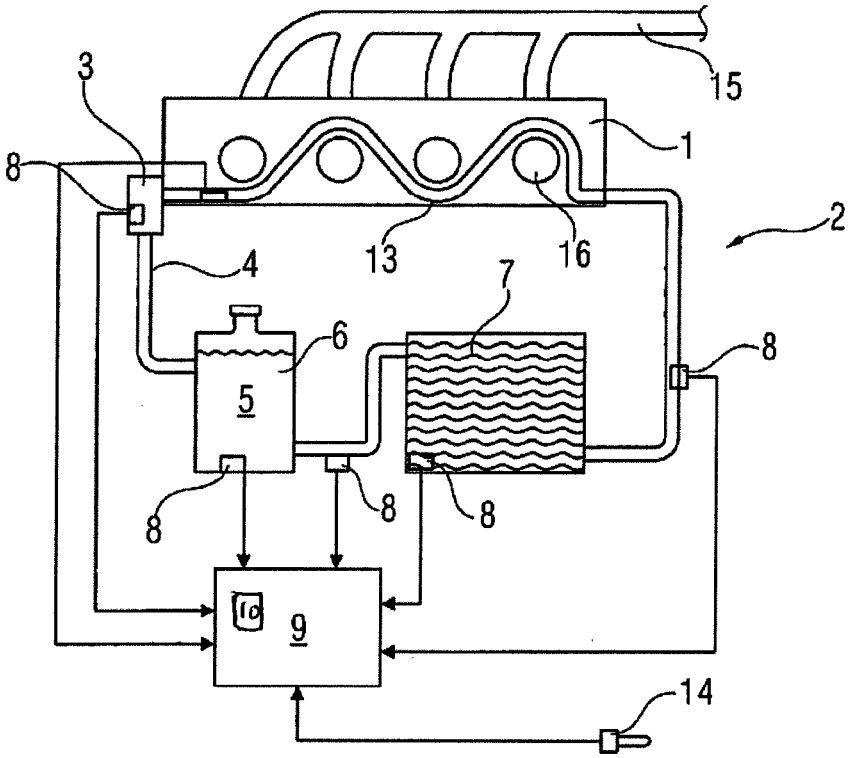
FIG. 1 shows an internal combustion engine with four cylinders.

FIG. 1 shows an internal combustion engine 1 with four cylinders 16 and an exhaust manifold 15 arranged on the internal combustion engine 1. In order to prevent overheating of the internal combustion engine 1 during the operation of the internal combustion engine 1, a coolant circuit 2 is formed on the internal combustion engine 1. The coolant circuit 2 for the internal combustion engine comprises a coolant pump 3, at least one coolant line 4, a radiator 7 and cooling cavities 13 in the internal combustion engine 1. By use of the cooling cavities 13 in the internal combustion engine 1, coolant 5 can absorb the heat from the hot internal combustion engine 1 and transport the heat away. For this purpose, the hot coolant 5 is transported by the coolant pump 3 through the coolant line 4 toward the radiator 7 where the coolant 5 is generally cooled by cold flowing air and is then supplied again to the internal combustion engine 1. The coolant 5 of an internal combustion engine 1 in motor vehicles is generally composed of water, to which a number of corrosion-reducing substances are added. This water has the property of freezing at temperatures below 0° C., which may result in serious damage to the internal combustion engine 1 or to the coolant circuit 2. Substances which reduce the freezing point of the solution to far below 0° C. are therefore generally added to the aqueous coolant 5. However, over the course of a lifetime of a vehicle, the concentration of the substances that reduce the freezing point of the coolant 5 may become too low, and therefore freezing of the internal combustion engine 1 or of the coolant circuit 2 is possible. In order to prevent this, a sensor 8 for monitoring the coolant concentration is fixedly and permanently arranged in the coolant circuit 2. The sensor 8 for monitoring the coolant concentration can be, for example, an ultrasonic sensor. Furthermore, an expansion vessel 6 can be arranged in the coolant circuit 2. The expansion vessel 6 can compensate for the thermal expansion of the coolant 5 in the coolant circuit 2. The sensor 8 for monitoring the coolant concentration can be arranged, for example, in or on the coolant cavity 13 of the internal combustion engine 1. In combination therewith or as an independent solution, the sensor 8 for monitoring the coolant concentration can be arranged on or in the coolant pump 3. Furthermore, the sensor 8 for monitoring the coolant concentration can be arranged in or on the coolant line 4 and/or in or on the radiator 7. The sensor 8 for monitoring the coolant concentration transmits the detected concentration of the coolant solution 5 to an electronic control device 9. The electronic control device 9 is configured to use information regarding the coolant concentration to determine the temperature below which the coolant agent 5 would freeze. This temperature can be compared with an outside temperature transmitted to the electronic control device 9 by an ambient temperature sensor 14. As soon as the electronic control unit identifies that the outside temperature is dropping below the freezing temperature of the coolant 5, the electronic control device can generate a warning signal and/or ensure electronically that the supercooled and/or frozen internal combustion engine is not started.

Figure 2:
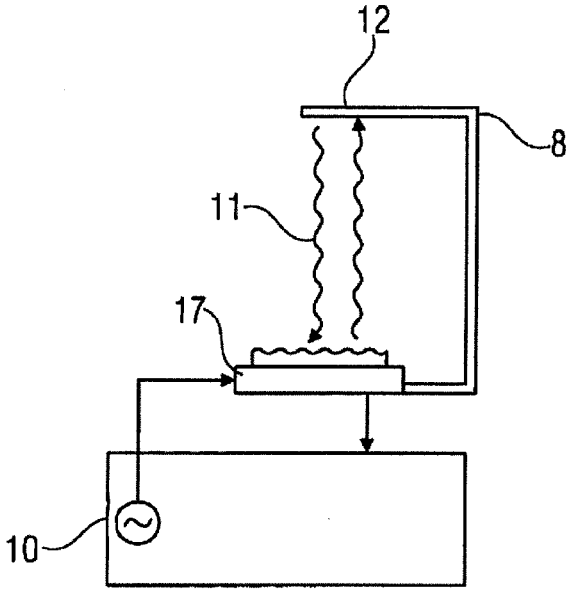
FIG. 2 shows a concentration sensor.

FIG. 2 shows a concentration sensor 8 which is designed as an ultrasonic sensor. The sensor element 17 is excited into vibrations by a frequency generator 10, which can be integrated in the electronic control device 9, for example, as shown in FIG. 1. However, the sensor element 17 can also be excited into vibrations by an electric circuit 10, wherein the electric circuit 10 is part of the concentration sensor 8 itself, as shown in FIG. 2. These vibrations have frequencies within the ultrasonic range, and therefore an ultrasonic wave 11 is emitted and runs through the coolant 5 to a reflector 12. The ultrasonic wave 11 is reflected at the reflector 12 and thrown back to the sensor element 17. The sensor element 17 then acts as a receiver for the ultrasonic wave 11, wherein the propagating time of the ultrasonic wave 11 from the sensor element 17 via the reflector 12 back to the sensor element 17 is characteristic of the concentration of additives reducing the freezing point in the coolant. The sensor 8 shown here for monitoring the coolant concentration can therefore output a corresponding signal regarding the concentration of the coolant to the electronic control device 9, and therefore the electronic control device 9 can then calculate the temperature from which the coolant 5 would freeze. The coolant circuit 2 presented here for an internal combustion engine 1 with at least one sensor 8 for monitoring the coolant concentration can contribute to avoiding expensive damage to the internal combustion engine 1 and therefore to protecting resources.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A coolant circuit (2) for an internal combustion engine (1), comprising:

a coolant pump (3);

at least one coolant line (4);

a radiator (7);

a coolant cavity (13) delimited in the internal combustion engine (1);

an electronic control device (9); and an ambient temperature sensor that measures an outside ambient temperature, the ambient temperature sensor being connected to the electronic control device (9), wherein the coolant pump (3), the coolant line (4), the radiator (7) and the coolant cavity (13) are filled with a coolant (5), one or more sensors (8), configured to monitor the coolant concentration, are fixedly and permanently arranged in or on the coolant circuit (2), at least one of the one or more sensors transmits measuring results thereof to the electronic control device (9), the electronic control device (9) ascertains a temperature below which the coolant (5) would freeze, with reference to the measuring results of at least one of the one or more sensors (8), and compares said temperature below which the coolant (5) would freeze with a measuring result of the ambient temperature sensor (14), and if the comparison between said temperature below which the coolant (5) would freeze and the measuring result of the ambient temperature sensor (14) indicates that the measuring result of the ambient temperature sensor (14) is below said temperature below which the coolant (5) would freeze, the electronic control device (9) electronically prevents the internal combustion engine from starting.

2. The coolant circuit (2) as claimed in claim 1, wherein at least one of the one or more sensors (8) is an ultrasonic sensor.

3. The coolant circuit (2) as claimed in claim 1, wherein the coolant circuit (2) additionally has an expansion vessel (6).

4. The coolant circuit (2) as claimed in claim 3, wherein at least one of the one or more sensors (8) is arranged in or on the expansion vessel (6).

5. The coolant circuit (2) as claimed in claim 1, wherein at least one of the one or more sensors (8) is arranged in or on the coolant cavity (13).

6. The coolant circuit (2) as claimed in claim 1, wherein at least one of the one or more sensors (8) is arranged in or on the coolant pump (3).

7. The coolant circuit (2) as claimed in claim 1, wherein at least one of the one or more sensors (8) is arranged in or on the coolant line (4).

8. The coolant circuit (2) as claimed in claim 1, wherein at least one of the one or more sensors (8) is arranged in or on the radiator (7).

9. The coolant circuit (2) as claimed in claim 1, wherein the electronic control device (9) generates an electronic warning signal if the comparison between said temperature below which the coolant (5) would freeze and the measuring result of the ambient temperature sensor (14) indicates that the measuring result of the ambient temperature sensor (14) is below said temperature below which the coolant (5) would.

10. The coolant circuit (2) as claimed in claim 9, wherein the monitoring of the coolant concentration and the ascertaining of said temperature below which the coolant (5) would freeze and the comparison with the measuring result of the ambient temperature sensor (14) take place even after the internal combustion engine comes to a standstill.

* * * * *